US008939553B2

(12) United States Patent
Domae et al.

(10) Patent No.: US 8,939,553 B2
(45) Date of Patent: Jan. 27, 2015

(54) HEAD CHIP THAT CIRCULATES LIQUID IN OPPOSITE DIRECTIONS WHILE SUPPLYING THE LIQUID TO LIQUID JET CHANNELS, LIQUID JET HEAD, AND LIQUID JET RECORDING APPARATUS

(71) Applicant: SII Printek Inc., Chiba (JP)

(72) Inventors: Yoshinori Domae, Chiba (JP); Yuki Yamamura, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 13/845,655

(22) Filed: Mar. 18, 2013

(65) Prior Publication Data

US 2013/0271529 A1 Oct. 17, 2013

(30) Foreign Application Priority Data

Mar. 21, 2012 (JP) ..... 2012-064265

(51) Int. Cl.
*B41J 2/045* (2006.01)
*B41J 2/145* (2006.01)
*B41J 2/14* (2006.01)

(52) U.S. Cl.
CPC ..... *B41J 2/145* (2013.01); *B41J 2/14209* (2013.01); *B41J 2202/12* (2013.01)
USPC ..... 347/68; 347/47; 347/70

(58) Field of Classification Search
CPC .... B41J 2/14145; B41J 2/14201; B41J 2/145; B41J 2/175; B41J 2/14209; B41J 2/055
USPC ..... 347/20, 44, 47, 65, 68, 70–71, 40, 42, 347/84–87
See application file for complete search history.

(56) References Cited

U.S. PATENT DOCUMENTS 6,568,796 B2 * 5/2003 Harajiri ..... 347/68

FOREIGN PATENT DOCUMENTS

JP 06143602 5/1994

* cited by examiner

*Primary Examiner* — Juanita D Jackson
(74) *Attorney, Agent, or Firm* — Adams & Wilks

(57) ABSTRACT

A head chip for a liquid jet head of a recording apparatus has liquid jet channels arranged in a longitudinal direction of the head chip, and nozzle holes that communicate with the liquid jet channels. A flow path plate covers the liquid jet channels and has first and second circulation paths that extend in the longitudinal direction of the head chip and communicate with the liquid jet channels to supply liquid thereto. First and second inflow ports are provided at opposite longitudinal ends of the head chip for inflowing liquid into the first and second circulation paths, respectively, so that liquid flows through the first and second circulation paths in opposite directions while being supplied to the liquid jet channels. The sum of pressures of liquid supplied to each liquid jet channel from the first and second circulation paths is uniform throughout the longitudinal direction of the head chip so that high image quality is realized.

9 Claims, 7 Drawing Sheets

HEAD CHIP THAT CIRCULATES LIQUID IN OPPOSITE DIRECTIONS WHILE SUPPLYING THE LIQUID TO LIQUID JET CHANNELS, LIQUID JET HEAD, AND LIQUID JET RECORDING APPARATUS

BACKGROUND OF THE INVENTION

1. Field of the Invention

The present invention relates to a head chip, a liquid jet head, and a liquid jet recording apparatus.

2. Description of the Related Art

As a liquid jet recording apparatus, there is known an ink jet type recording apparatus which jets ink, functional liquid, or the like onto a recording medium or the like to record a predetermined pattern such as text or graphics. This inkjet type recording apparatus is configured to, for example, supply liquid such as ink or functional liquid from a liquid tank via a supply tube to a liquid jet head, fill a liquid jet channel provided in the head chip with the liquid, deform the liquid jet channel by application of voltage, and jet the filled liquid from a nozzle communicating thereto by the change in capacity by the deformation.

In an inkjet recording apparatus disclosed in Japanese Patent Application Laid-open No. Hei 6-143602, as an ink supply system for supplying ink to an ink jet head, there is adopted a circulating system which circulates ink between the ink jet head and an ink tank. The ink jet head has a channel on the head inner side with respect to a nozzle array. An ink supply flow path is connected to one end side of the channel, and an ink discharge flow path is connected to the other end side of the channel. Ink is supplied from the ink supply flow path to the channel, and part of the ink is jetted from a nozzle by actuation of an oscillator. The excess ink is returned through the ink discharge flow path to the ink tank.

By the way, in an ink jet head with an ink circulating system using a liquid flow path having a flow inlet and a flow outlet of ink as mentioned above, difference in pressure is caused between the flow inlet side and the flow outlet side due to pressure loss in the head. Therefore, difference in volume is caused between a nozzle which is near the flow inlet and a nozzle which is near the flow outlet when ink is jetted, and the volume of ink gradually reduces in the order of the nozzles. Thus, there is a problem that density gradation appears in the direction of the nozzle array (direction of extension of the nozzle array) to affect the image quality.

In particular, when a plurality of ink jet heads are arranged side by side in the direction of extension of the nozzle array, a nozzle which is near the flow outlet and has a small ink volume and a nozzle which is near the flow inlet and has a large ink volume are arranged so as to be adjacent to each other. Then, the density contrast between the nozzles is conspicuous, and thus, there is a problem that the contrast appears as streaks between the ink jet heads to affect the image quality.

SUMMARY OF THE INVENTION

The present invention has been made in view of the above-mentioned problems, and it is an object of the present invention to provide a head chip, a liquid jet head, and a liquid jet recording apparatus which can reduce the effect on the image quality due to difference in volume of jetted liquid caused by pressure loss of the liquid during the liquid is in the process of circulating through a liquid flow path.

As a measure to solve the above-mentioned problems, according to an exemplary embodiment of the present invention, there is provided a head chip for a liquid jet head of a liquid jet recording apparatus, the head chip including: an actuator plate having, in one side surface thereof, a plurality of liquid jet channels arranged in a longitudinal direction of the head chip; a flow path plate mounted to the one side surface of the actuator plate, for covering the plurality of liquid jet channels; and a nozzle plate having a plurality of nozzle holes communicating to ends on a downstream side of the plurality of liquid jet channels. The flow path plate has a first circulation path and a second circulation path extending along the longitudinal direction of the head chip so as to communicate to portions of the plurality of liquid jet channels, which are away from the plurality of nozzle holes on an upstream side. The first circulation path and the second circulation path enable liquid to flow, the liquid being supplied to the plurality of liquid jet channels, and form liquid flows which are symmetrical with each other in the longitudinal direction of the head chip.

In the exemplary embodiment of the present invention, the head chip may further include: a first manifold portion for supplying liquid to one of the first circulation path and the second circulation path and for discharging excess liquid which flows through another of the first circulation path and the second circulation path; and a second manifold portion for supplying liquid to the another of the first circulation path and the second circulation path and for discharging excess liquid which flows through the one of the first circulation path and the second circulation path.

In this case, the first manifold portion may be provided at one end portion of the head chip in the longitudinal direction and the second manifold portion may be provided at another end portion of the head chip in the longitudinal direction.

Further, in the exemplary embodiment of the present invention, the head chip may include a plurality of single head chips each including one actuator plate and one flow path plate.

In this case, the first circulation path and the second circulation path in the flow path plate may be formed into a shape of grooves which are open to a side opposite to the actuator plate. The first circulation path and the second circulation path may have, in bottom portions thereof, a plurality of first communicating openings and a plurality of second communicating openings, respectively, which reach the portions of the plurality of liquid jet channels in the actuator plate, which are away on the upstream side. The plurality of single head chips may be coupled in pairs so that open portions of the first circulation paths and the second circulation paths in the flow path plates thereof are opposed to each other.

Further, in this case, the plurality of nozzle holes and the plurality of liquid jet channels are arranged so that positions thereof are offset in the longitudinal direction in the head chip between adjacent single head chips.

According to another exemplary embodiment of the present invention, there is provided a liquid jet head, including the head chip.

In this case, the head chip may include a plurality of head chips arranged side by side in a direction of a nozzle array.

Further, according to another exemplary embodiment of the present invention, there is provided a liquid jet recording apparatus, including: the liquid jet head; a liquid supplying portion for supplying liquid to the liquid jet head; and a recording medium conveying portion for conveying a recording medium so as to pass a location opposed to the liquid jet head.

According to the present invention, even when the pressure of liquid changes in the longitudinal direction of the head chip due to pressure loss of liquid in the first and second circulation paths, liquid which flows through the first and second circulation paths forms flows which are symmetrical in the longitudinal direction of the head chip. Thus, the sum of pressures of liquid supplied from the first and second circulation paths to an upstream side of the liquid jet channels is uniform in the longitudinal direction of the head chip. Therefore, even in a liquid jet head including a long head chip, difference in volume of ejected ink can be inhibited in the longitudinal direction of the head chip to enhance the print quality.

DETAILED DESCRIPTION OF THE PREFERRED EMBODIMENT

An embodiment of the present invention is described in the following with reference to the attached drawings. Note that, in the following description, a head chip, a liquid jet head, and a liquid jet recording apparatus which jet ink as liquid are described by way of example.

Figure 11:
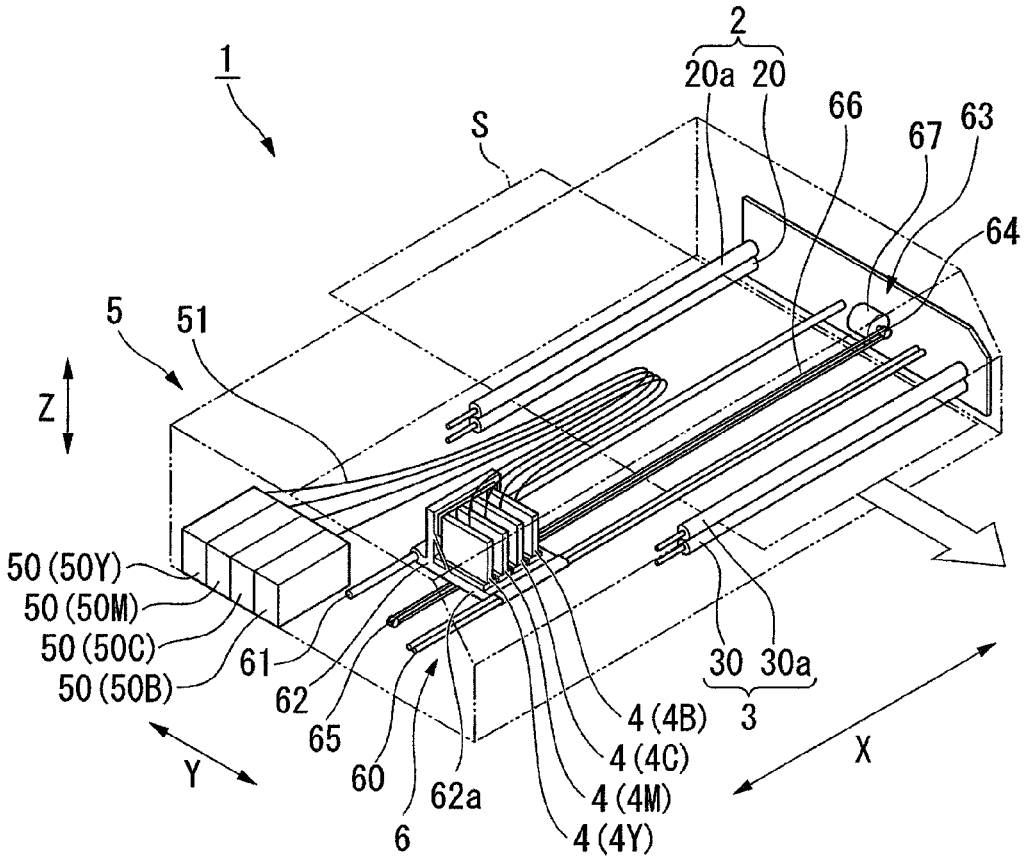
FIG. 11 is a perspective view of a liquid jet recording apparatus including a liquid jet head having the head chip.

As illustrated in FIG. 11, a liquid jet recording apparatus 1 includes a pair of conveying means (recording medium conveying portions) 2 and 3 that convey a recording medium S such as paper, a liquid jet head 4 that jets ink onto the recording medium S, ink supply means (liquid supplying potion) 5 for supplying ink to the liquid jet head 4, and scanning means 6 for scanning the liquid jet head 4 in a direction (hereinafter referred to as "X direction") substantially orthogonal to the conveying direction (hereinafter referred to as "Y direction") of the recording medium S.

The pair of conveying means 2 and 3 include grid rollers 20 and 30 extending in the X direction, pinch rollers 20*a* and 30*a* extending in parallel to the grid rollers 20 and 30, and a drive mechanism (not shown) such as a motor, which axially rotates the grid rollers 20 and 30, respectively.

The ink supply means 5 includes an ink tank 50 in which ink is housed, and an ink pipe 51 that connects the ink tank 50 to the liquid jet head 4. There are provided a plurality of the ink tanks 50, and more specifically, ink tanks 50Y, 50M, 50C, and 50B for four kinds of ink consisting of yellow, magenta, cyan, and black are provided side by side in the Y direction. The ink pipe 51 is formed of a flexible hose having flexibility adaptive to the operation of the liquid jet head 4 (carriage 62).

The scanning means 6 includes a pair of guide rails 60 and 61 extending in the X direction, the carriage 62 slidable along the pair of guide rails 60 and 61, and a drive mechanism 63 that moves the carriage 62 in the X direction. The drive mechanism 63 includes a pair of pulleys 64 and 65 disposed between the pair of guide rails 60 and 61, an endless belt 66 wound around the pair of pulleys 64 and 65, and a drive motor 67 that rotationally drives the pulley 64 of the pair.

The pair of pulleys 64 and 65 are disposed between both ends of the pair of guide rails 60 and 61, respectively, and arranged at an interval in the X direction. The endless belt 66 is disposed between the pair of guide rails 60 and 61, and the endless belt is coupled with the carriage 62. The plurality of liquid jet heads 4 are mounted on the carriage 62, and more specifically, liquid jet heads 4Y, 4M, 4C, and 4B for four kinds of ink consisting of yellow, magenta, cyan, and black are mounted side by side in the X direction.

The liquid jet head 4 includes a head chip 41, a base plate (not shown), and a wiring board (not shown). A wiring board is mounted to a surface of the base plate. A control circuit for controlling the head chip 41 is formed on the wiring board.

Figure 1:
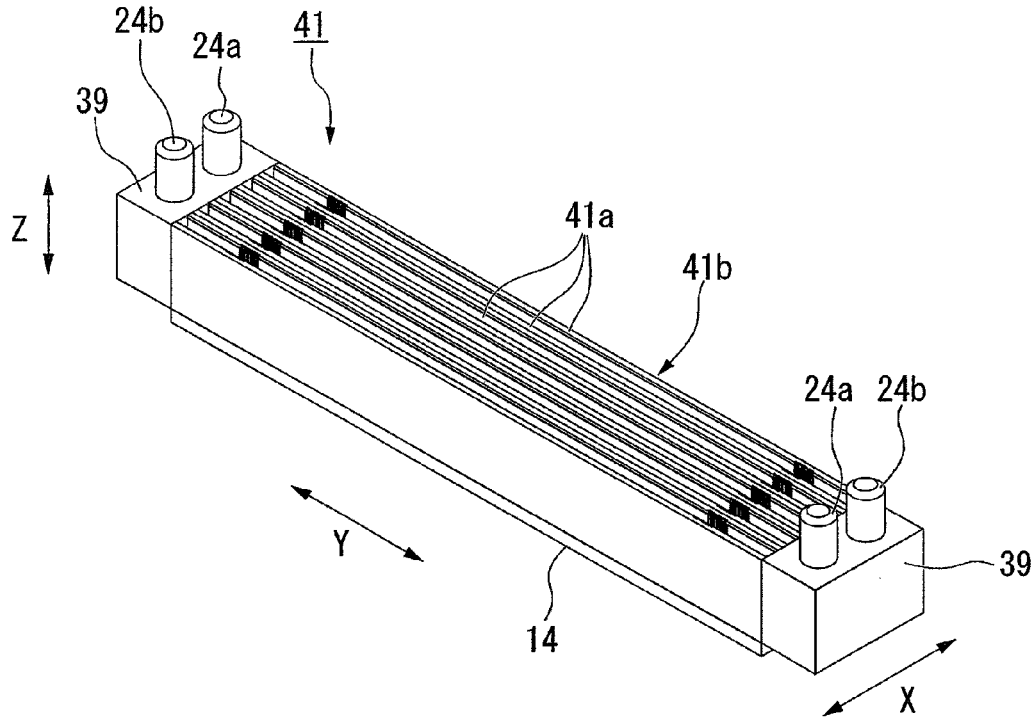
FIG. 1 is a perspective view of a head chip according to an embodiment of the present invention.
Figure 2:
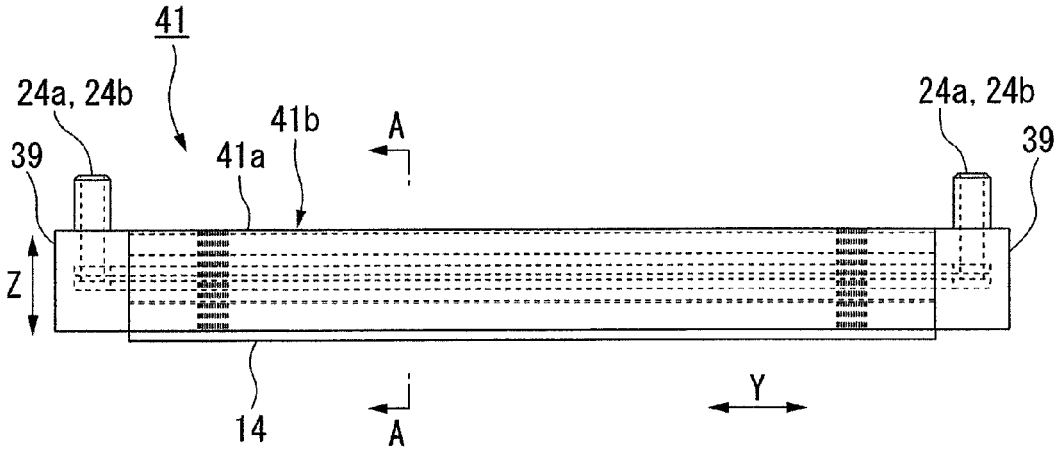
FIG. 2 is a front view of the head chip seen from an X direction.

As illustrated in FIG. 1, the head chip 41 has an outer appearance formed into a shape of a rectangular parallelepiped which is elongated in the direction of conveyance of the recording medium S (Y direction in the figure). In the head chip 41, the Y direction is a width direction (longitudinal direction), the X direction which is orthogonal to the Y direction and along a print surface of the recording medium S is a depth direction, and a Z direction which is orthogonal to both the X direction and the Y direction is a height direction.

The head chip 41 has a structure in which a plurality of (in this embodiment, ten, see FIG. 4) plate-like single head chips 41*a* each formed into a shape of a rectangle that is elongated in the Y direction and that is substantially orthogonal to the X direction are arranged in the X direction. The head chip 41 includes a pair of manifold blocks 39 which are mounted to both end portions of the plurality of single head chips 41*a* in the Y direction to enable supply and discharge of ink thereto and therefrom, and a nozzle plate 14 mounted to end portions on one side (lower side in the figure) of the plurality of single head chips 41*a* in the Z direction (end portions on the recording medium S side).

Figure 3A:
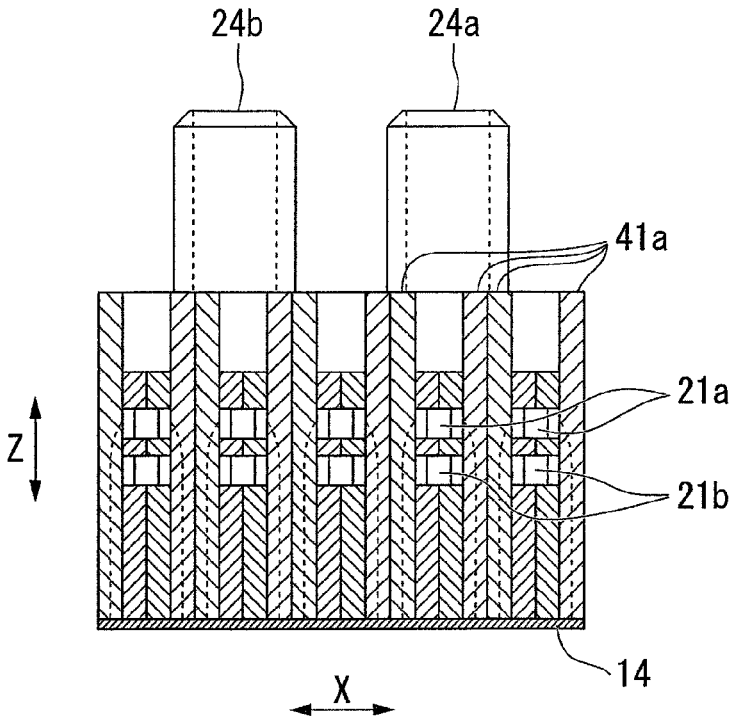
FIG. 3A is a sectional view taken along the line A-A of FIG. 2.
Figure 3B:
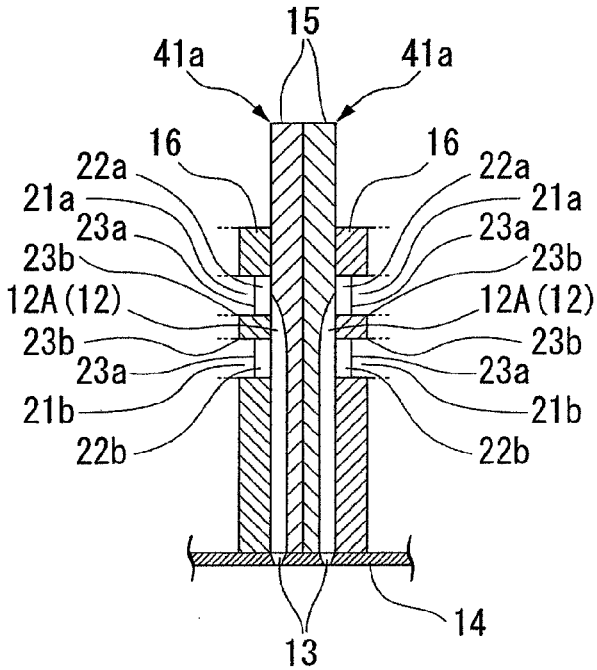
FIG. 3B is a partial enlarged view of FIG. 3A.
Figure 7:
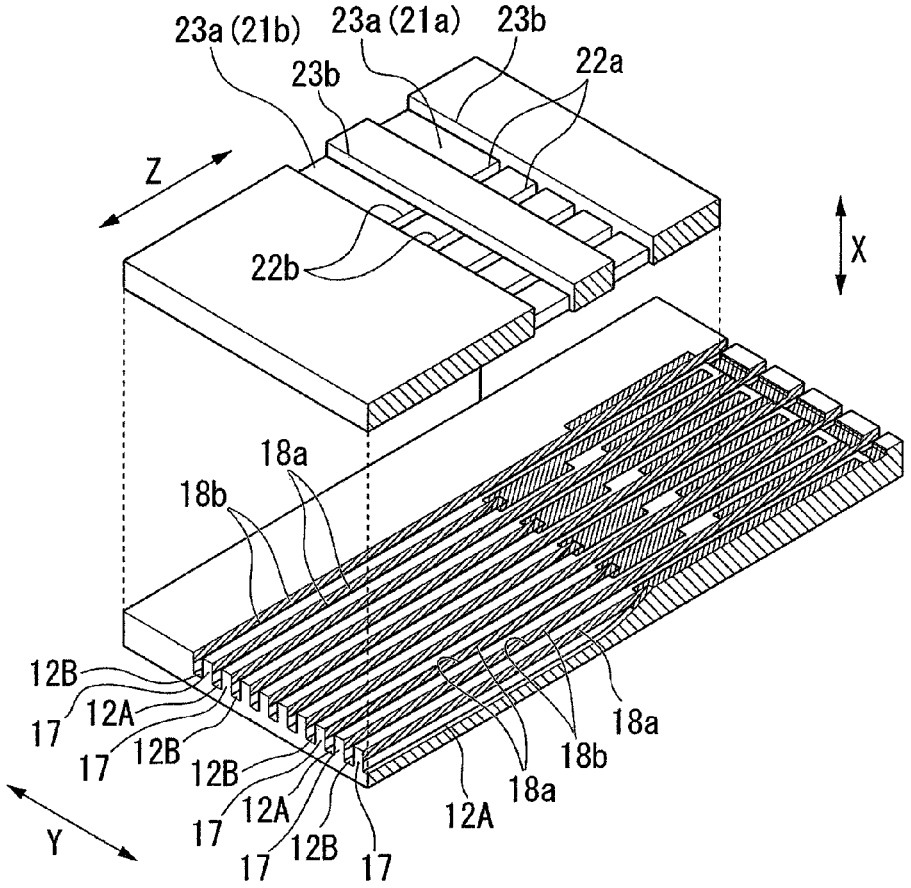
FIG. 7 is an exploded perspective view of the head chip, in which an actuator plate and a flow path plate are separated from each other.

As illustrated in FIGS. 3B and 7, each of the single head chips 41*a* integrally includes an actuator plate 15 having a plurality of groove-like channels 12 arranged parallel to one another and formed in one side surface of the actuator plate 15 in the X direction (thickness direction), and a flow path plate 16 mounted to the one side surface of the actuator plate 15, for appropriately covering all the channels 12.

The actuator plate 15 is a rectangular plate made of a piezoelectric material such as lead zirconate titanate (PZT). In the one side surface of the actuator plate 15, the plurality of groove-like channels 12 that are rectangular in section and extend along the lateral direction (Z direction) of the actuator plate 15 are formed. Portions each between two adjacent channels 12 in the actuator plate 15 are protruding piezoelectric bodies 17 which are rectangular in section and extend along the Z direction. The channels 12 and the piezoelectric bodies 17 are arranged at regular intervals in the longitudinal direction (Y direction) of the actuator plate 15, respectively.

All the channels 12 are broadly divided into liquid jet channels 12A (common channels) which can jet ink droplets, and dummy channels 12B which cannot jet ink droplets. The liquid jet channels 12A and the dummy channels 12B are alternately arranged side by side in the Y direction. In FIG. 1, only part of all the channels 12 is illustrated.

The one side of each of the liquid jet channels 12A and dummy channels 12B in the Z direction reaches a lower end of the actuator plates 15 in FIG. 3B while maintaining a constant depth. The lower end of each of the liquid jet channels 12A and dummy channels 12B in FIG. 3B is blocked by the nozzle plate 14 mounted to the lower end of the actuator plate 15 in FIG. 3B. In the nozzle plate 14, nozzle holes 13 located on the one side of the liquid jet channel 12A in the Z direction are formed so as form the nozzle array along the Y direction.

Each of the liquid jet channels 12A becomes gradually shallower upward in the figure, i.e., toward the other side thereof in the Z direction by the slant of a bottom surface thereof, and terminates midway of the actuator plate 15 in the Z direction. The other side of each of the dummy channels 12B in the Z direction reaches an upper end of the actuator plates 15 in FIG. 3B while maintaining a constant depth.

First and second communicating openings 22*a* and 22*b* formed in the flow path plate 16 are arranged side by side in the Z direction on one side of each of the liquid jet channels 12A in the X direction (on the flow path plate 16 side). Ink is introduced into each of the liquid jet channels 12A from first and second circulation paths 21*a* and 21*b* in the flow path plate 16 via the first and second communicating openings 22*a* and 22*b*. Ink in the liquid jet channels 12A is jetted from the nozzle holes 13 in the nozzle plate 14 toward the recording medium S on the one side thereof in the Z direction.

A common electrode 18*a* is provided on each of the piezoelectric bodies 17 on the liquid jet channel 12A side, and a drive electrode 18*b* is provided on each of the piezoelectric bodies 17 on the dummy channel 12B side. The common electrode 18*a* and the drive electrode 18*b* are band-like electrodes extending in the Z direction, and deposited on the side surfaces of each of the piezoelectric bodies 17 in the Y direction on the distal end side. The drive electrodes 18*b* of the pair of piezoelectric bodies 17, respectively, sandwiching the liquid jet channel 12A, are mutually coupled with each other so as to be applied with the same voltage. All of the common electrodes 18*a* are grounded.

In this structure, when voltage is applied to the drive electrodes 18*b* of the pair of piezoelectric bodies 17, respectively, sandwiching the liquid jet channel 12A, the pair of piezoelectric bodies 17 are deformed to cause pressure fluctuations in the liquid jet channel 12A therebetween to jet ink in the liquid jet channel 12A from the nozzle hole 13. A flexible substrate (not shown) for connecting the common terminal and the drive terminal to the outside is mounted on the other side of the actuator plate 15 in the Z direction.

As illustrated in FIGS. 3A, 3B, 4, and 7, the flow path plate 16 is a rectangular plate which is formed of a ceramic-based piezoelectric material that is the same as the material of the actuator plate 15 and which is overlaid on the actuator plate 15, and covers the one side of all the liquid jet channels 12A and all the dummy channels 12B in the Z direction from the one side in the X direction.

In one side surface of the flow path plate 16 on the side (on the one side in the X direction) opposite to the actuator plate 15 to which the flow path plate 16 is mounted, the groove-like first and second circulation paths 21*a* and 21*b* which are open to the side opposite to the actuator plate 15 are individually formed. The first and second circulation paths 21*a* and 21*b* each have a shape of an identical rectangle in section and extend along the Y direction. The first and second circulation paths 21*a* and 21*b* are located so as to overlap in the Z direction a portion of the liquid jet channel 12A which is away from the nozzle hole 13 on the other side in the Z direction (upstream side in an ink flow path). The portion of the liquid jet channel 12A which is away from the nozzle hole 13 on the other side in the Z direction is hereinafter sometimes simply referred to as the upstream side of the liquid jet channel 12A.

The first and second communicating openings 22*a* and 22*b* for connecting the first and second circulation paths 21*a* and 21*b* to the liquid jet channels 12A are formed at the bottom of the first and second circulation paths 21*a* and 21*b* on the actuator plate 15 side (on the other side in the X direction). Portions denoted by 23*a* in the figure are bottom portions of the groove-like first and second circulation paths 21*a* and 21*b* on the actuator plate 15 side, and portions denoted by 23*b* in the figure are open portions of the groove-like first and second circulation paths 21*a* and 21*b* on the side opposite to the actuator plate 15.

Figure 4:
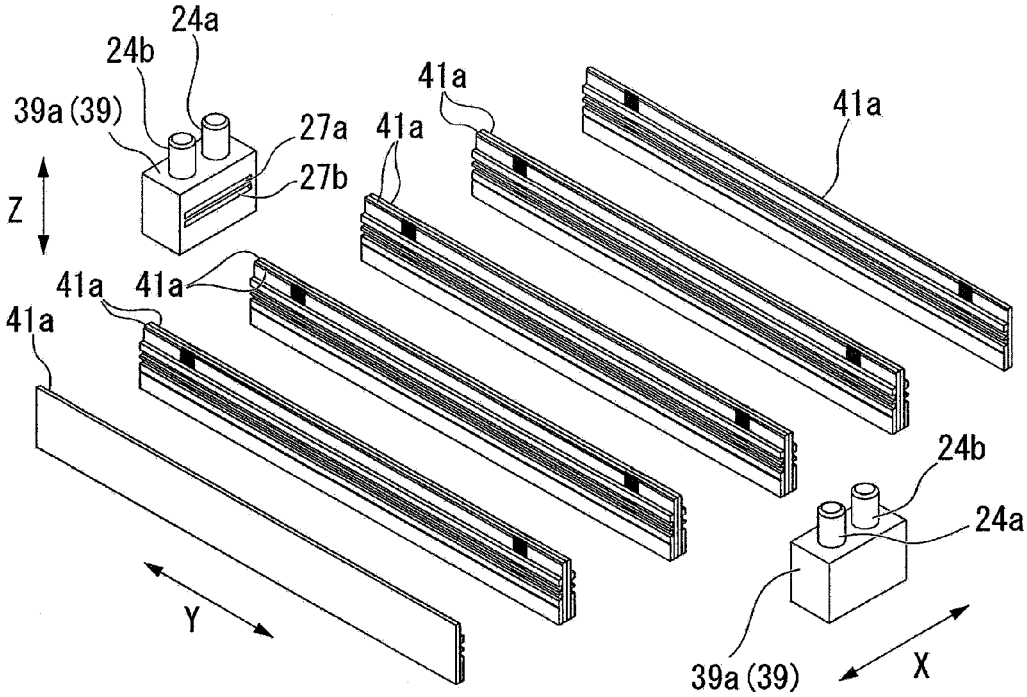
FIG. 4 is an exploded perspective view of the head chip.

As illustrated in FIGS. 3A, 3B, and 4, ten single head chips 41*a* of the head chip 41 are overlaid on one another in pairs so that the flow path plates 16 thereof abut against each other in the X direction. In FIG. 4, the single head chips 41*a* except two single head chips 41*a* located at both ends of the head chip 41 in the X direction, i.e., eight single head chips 41*a* in the middle in the X direction, are coupled in pairs and are overlaid on one another so that rear surfaces of the actuator plates 15 (surfaces on sides opposite to the flow path plates 16, respectively) abut against each other in the X direction.

Note that, all the ten single head chips 41*a* may be coupled in pairs and may be overlaid on each other so that the flow path plates 16 thereof abut against each other in the X direction. In this case, ink passages of a closed cross section can be easily formed from the groove-like first and second circulation paths 21*a* and 21*b*, and pressure loss of ink which flows through the first and second circulation paths 21*a* and 21*b* can be reduced by integration of the first and second circulation paths 21*a* and 21*b* in pairs. It is also possible to form the head chip 41 only by a pair of single head chips 41*a*.

Figure 8:
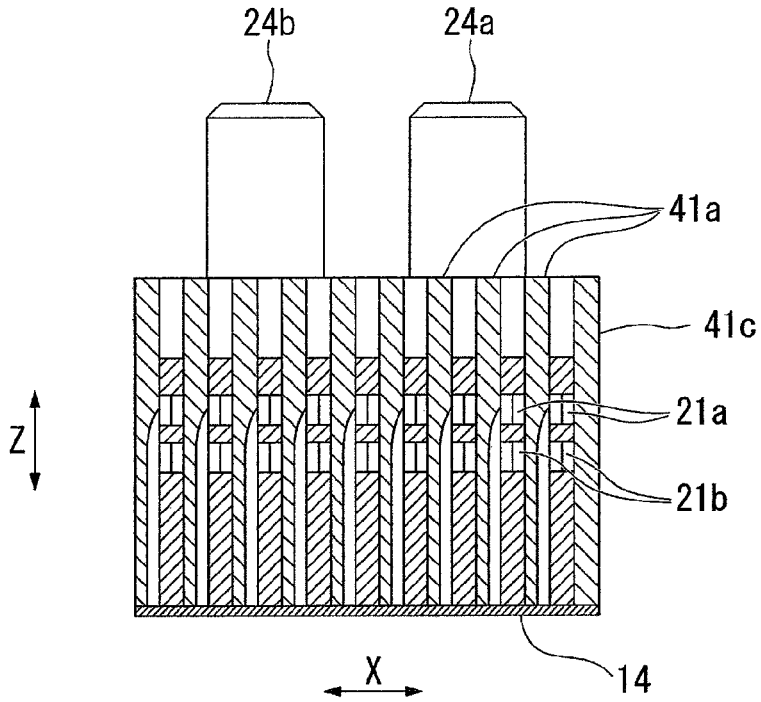
FIG. 8 is a sectional view corresponding to FIG. 3A, which illustrates a modified example of the head chip.

Further, as illustrated in FIG. 8, all the single head chips 41*a* may be arranged side by side in the X direction in the same orientation under a state in which a flow path plate 16 of a single head chip 41*a* abut against and is overlaid on the rear surface of the actuator plate 15 of an adjacent single head chip 41*a* from the one side toward the other side in the X direction, and an additional cover plate 41*c* may be overlaid on the flow path plate 16 side of a single head chip 41*a* which is located outermost on the other side in the X direction, the cover plate 41*c* covering the first and second circulation paths 21*a* and 21*b* of the single head chip 41*a*. In this case, the orientation of the single head chips 41*a* is the same, which eases the assembly. Further, it is also possible to form the head chip 41 by the combination of only one single head chip 41*a* and only one cover plate 41*c*.

Figure 5:
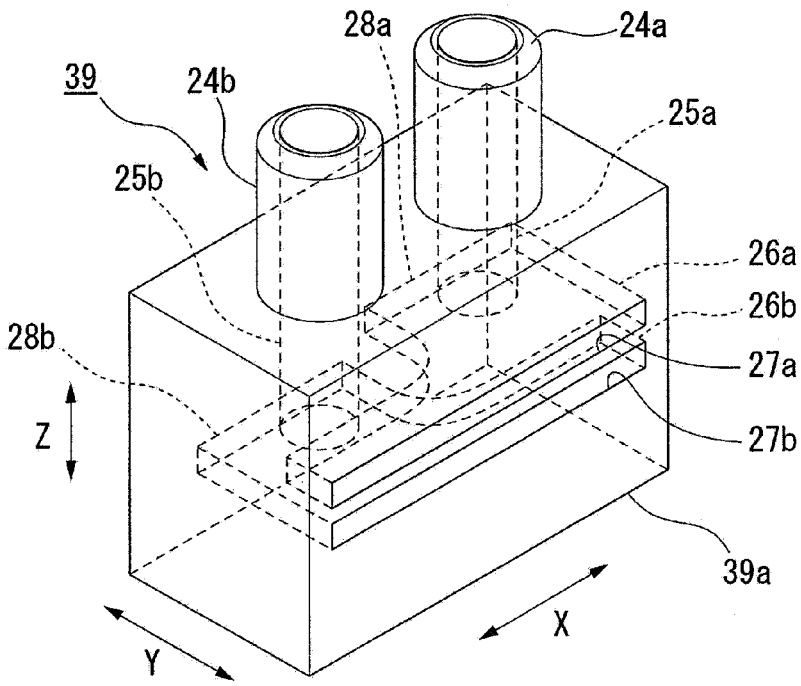
FIG. 5 is a perspective view of a manifold block of the head chip.
Figure 6:
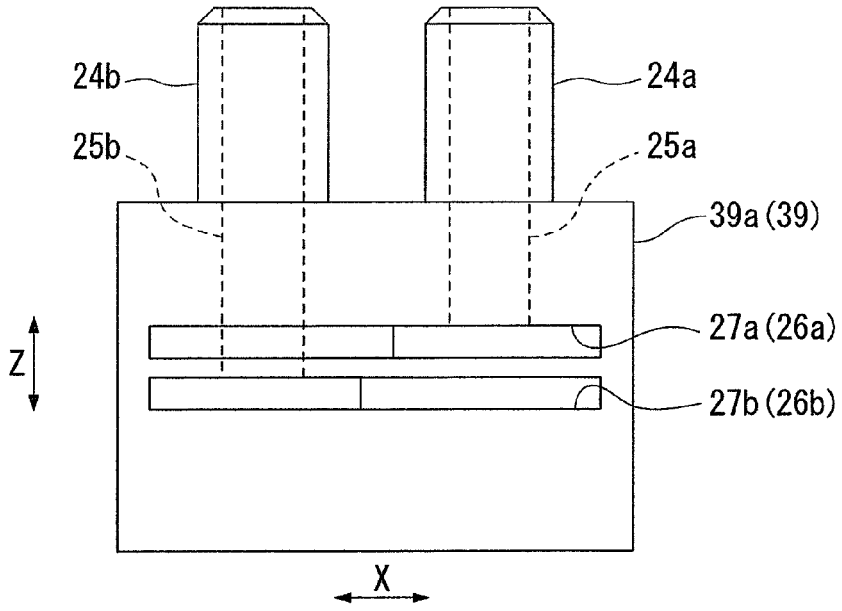
FIG. 6 is a front view of the manifold block seen from a Y direction.

As illustrated in FIGS. 4, 5, and 6, the manifold block 39 is made of, for example, a ceramic-based piezoelectric material which is the same as the material of the actuator plate 15 and the like. The manifold block 39 includes a manifold body 39*a* formed into a shape of a rectangular parallelepiped which covers one of both end portions in the X direction of a laminate 41*b* formed by laminating all the single head chips 41*a*, and a pair of cylindrical inflow/outflow tubes 24*a* and 24*b* protruding upward in the figure from an end on the other side of the manifold body 39*a* in the Z direction along the Z direction.

The manifold body 39*a* includes a pair of inflow/outflow paths 25*a* and 25*b* coaxially communicating to the pair of inflow/outflow tubes 24*a* and 24*b*, respectively, on the one side in the Z direction, the pair of inflow/outflow tubes 24*a* and 24*b* being arranged side by side in the X direction, and a pair of inflow/outflow ports 26*a* and 26*b* formed in a middle portion in the Z direction so as to be flattened with the width thereof in the Z direction being reduced, so as to be in two layers in the Z direction, and so as to communicate to the inflow/outflow paths 25*a* and 25*b*, respectively.

The inflow/outflow ports 26*a* and 26*b* form, on one side in the Y direction (on a center side of the laminate 41*b* in the Y direction), slit-like openings 27*a* and 27*b*, respectively, which are elongated in the X direction. In FIG. 5, the inflow/outflow port 26*a* on the other side in the Z direction is formed so that only a portion 28*a* thereof on the one side in the X direction increases the depth to the other side in the Y direction (opposite side to the laminate 41*b*), and communicates only to the inflow/outflow path on the one side in the X direction. Similarly, the inflow/outflow port 26*b* on the one side in the Z direction is formed so that only a portion 28*b* thereof on the other side in the X direction increases the depth to the other side in the Y direction (opposite side to the laminate 41*b*), and communicates only to the inflow/outflow path on the other side in the X direction.

Figure 9:
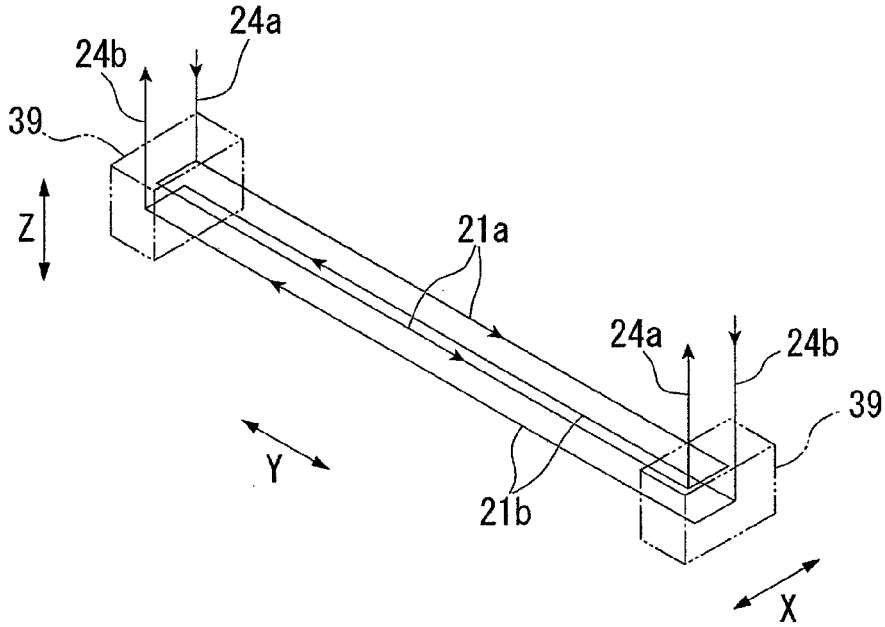
FIG. 9 is an explanatory diagram illustrating flows of ink in the head chip.

As illustrated in FIGS. 5 and 9, when the manifold blocks 39 are identical to each other, ink introduced from the inflow/outflow tube 24*a* on the one side of a first manifold block 39 in the X direction (upper left in FIG. 9) into the inflow/outflow port 26*a* on the other side of the first manifold block 39 in the Z direction passes through the first circulation paths 21*a* on the other side of each single head chip 41*a* in the Z direction and is appropriately jetted from the liquid jet channels 12A, and the excess ink passes through the first circulation paths 21*a* to reach the inflow/outflow port 26*a* on the other side of a second manifold block 39 (lower right in FIG. 9) in the Z direction, and is introduced to the outside from the inflow/outflow tube 24*a* on the other side of the second manifold block 39 in the X direction.

Further, ink introduced from the inflow/outflow tube 24*b* on the one side of the second manifold block 39 in the X direction into the inflow/outflow port 26*b* on the one side of the second manifold block 39 in the Z direction passes through the second circulation paths 21*b* on the one side of each single head chip 41*a* in the Z direction and is appropriately jetted from the liquid jet channels 12A, and the excess ink passes through the second circulation paths 21*b* to reach the inflow/outflow port 26*b* on the one side of the first manifold block 39 in the Z direction, and is introduced to the outside from the inflow/outflow tube 24*b* on the other side of the first manifold block 39 in the X direction.

In this way, by forming ink flows from ink introducing portions (one end portions in the Y direction) to ink discharging portions (the other end portions in the Y direction) in the first and second circulation paths 21*a* and 21*b* to be symmetrical in the Y direction, the sum of pressures of ink supplied to the upstream side of the liquid jet channels 12A from the first and second circulation paths 21*a* and 21*b* is uniform in the longitudinal direction of the head chip 41, and thus, difference in pressure of ejected ink is inhibited in the longitudinal direction of the head chip 41.

Note that, when the manifold blocks 39 are symmetrical in the Y direction, the inflow/outflow tubes for introducing ink are on the same side in the X direction, and the inflow/outflow tubes for discharging ink are on the same side in the X direction.

As illustrated in FIGS. 1, 2, 3A, and 3B, the nozzle plate 14 is a rectangular plate which is positioned orthogonal to the Z direction and which is elongated in the Y direction, and is provided so as to be over end portions of all the single head chips 41*a* on the one side in the Z direction. The nozzle plate 14 blocks the end portions of all the channels 12 of all the single head chips 41*a* on the one side in the Z direction, and enables ink in the liquid jet channels 12A of all the single head chips 41*a* to be jetted to the one side in the Z direction from the nozzle holes 13 formed in the nozzle plate 14 at regular intervals in the X direction.

Figure 10:
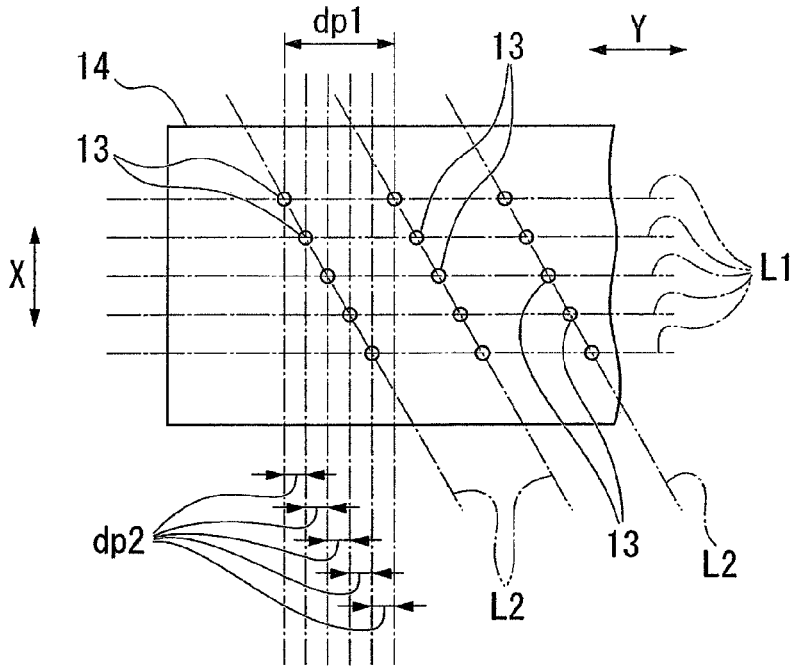
FIG. 10 is a plan view of a nozzle plate of the head chip seen from a Z direction.

As illustrated in FIG. 10, the positions of the nozzle holes 13 in the nozzle plate 14 in the X direction are the same for every single head chips 41*a*, and are arranged on lines L1 along the Y direction. On the other hand, the positions of the nozzle holes 13 in the Y direction are offset by a predetermined amount of dp2 between adjacent single head chips 41*a*, and are arranged on lines L2 which are tilted relative to the X direction.

A pitch dp1 between liquid jet channels 12A in a single head chip 41*a* is necessary to some extent (for example, 141.1 μm for 90 dpi) for reasons of shape forming and the like, but, in the head chip 41 of this embodiment, by the offset of the positions of the liquid jet channels 12A and the nozzle holes 13 in the Y direction by the predetermined amount of dp2 (for example, in the illustrated case, ⅕ of the pitch dp1) between adjacent single head chips 41*a*, the pitch of dots in the Y direction in printing is practically reduced to dp2, which enables the printing resolution to be enhanced.

As described above, the head chip 41 in the above-mentioned embodiment used in the liquid jet head 4 of the liquid jet recording apparatus 1 includes the actuator plate 15 having, in one side surface thereof, the plurality of liquid jet channels 12A arranged in the longitudinal direction of the head chip 41, the flow path plate 16 mounted to the one side surface of the actuator plate 15, for covering the plurality of liquid jet channels 12A, and the nozzle plate 14 having the plurality of nozzle holes 13 communicating to ends on a downstream side of the plurality of liquid jet channels 12A. The flow path plate 16 has the first and second circulation paths 21*a* and 21*b* extending along the longitudinal direction of the head chip 41 so as to communicate to the upstream side of the plurality of liquid jet channels 12A. The first and second circulation paths 21*a* and 21*b* enable ink to flow, the ink being supplied to the plurality of liquid jet channels 12A, and form ink flows which are symmetrical with each other in the longitudinal direction of the head chip 41.

According to this structure, even when the pressure of ink changes in the longitudinal direction of the head chip 41 due to pressure loss of ink in the first and second circulation paths 21*a* and 21*b*, ink which flows through the first and second circulation paths 21*a* and 21*b* forms flows which are symmetrical in the longitudinal direction of the head chip 41, and thus, the sum of pressures of ink supplied from the first and second circulation paths 21*a* and 21*b* to the upstream side of the liquid jet channels 12A is uniform in the longitudinal direction of the head chip 41. Therefore, even in the liquid jet head 4 including the long head chip 41, difference in volume of ejected ink can be inhibited in the longitudinal direction of the head chip 41 to enhance the print quality.

Further, the head chip 41 includes the first manifold block 39 for supplying ink to one of the first and second circulation paths 21*a* and 21*b* and for discharging excess ink which flows through the other of the first and second circulation paths 21*a* and 21*b*, and the second manifold block 39 for supplying ink to the other of the first and second circulation paths 21*a* and 21*b* and for discharging excess ink which flows through the one of the first and second circulation paths 21*a* and 21*b*. Thus, compared with a case in which a structure for supplying ink and a structure for discharging ink are separately provided for the respective first and second circulation paths 21*a* and

21*b*, the structure for supplying ink and discharging ink for the first and second circulation paths 21*a* and 21*b* can be simplified.

Further, in the head chip 41, the first manifold block 39 is provided at one end portion of the head chip 41 in the longitudinal direction, and the second manifold block 39 is provided at the other end portion of the head chip 41 in the longitudinal direction, and thus, the ink flows which are symmetrical in the longitudinal direction of the head chip 41 can be formed without fail.

Further, the head chip 41 includes the plurality of single head chips 41*a* each including one actuator plate 15 and one flow path plate 16, and thus, ink can be ejected from the plurality of single head chips 41*a* to enhance the density of an image formed by the liquid jet head 4, and can easily carry out printing with high resolution.

Further, in the head chip 41, the first and second circulation paths 21*a* and 21*b* in the flow path plate 16 are formed into a shape of grooves which are open to the side opposite to the actuator plate 15, the plurality of first and second communicating openings 22*a* and 22*b* reaching the upstream side of the plurality of liquid jet channels 12A in the actuator plate 15 are formed in the bottom portions 23*a* of the first and second circulation paths 21*a* and 21*b*, respectively, and the plurality of single head chips 41*a* are coupled in pairs so that the open portions 23*b* of the first and second circulation paths 21*a* and 21*b* in the flow path plates 16 thereof are opposed to each other. Thus, the ink passages of a closed cross section can be easily formed from the groove-like first and second circulation paths 21*a* and 21*b*, and pressure loss of ink which flows through the first and second circulation paths 21*a* and 21*b* can be reduced by integration of the first and second circulation paths 21*a* and 21*b* in a pair.

Further, in the head chip 41, the plurality of nozzle holes 13 and the plurality of liquid jet channels 12A are arranged so that the positions thereof are offset in the longitudinal direction of the head chip 41 between adjacent single head chips 41*a*. Thus, the dot density of the head chip 41 in the longitudinal direction can be increased.

The liquid jet head 4 in the above-mentioned embodiment includes the head chip 41, and the liquid jet recording apparatus 1 in the above-mentioned embodiment includes the liquid jet head 4, the ink supply means 5 for supplying ink to the liquid jet head 4, and conveying means 2 and 3 for conveying the recording medium S so as to pass a location opposed to the liquid jet head 4.

Figure 12:
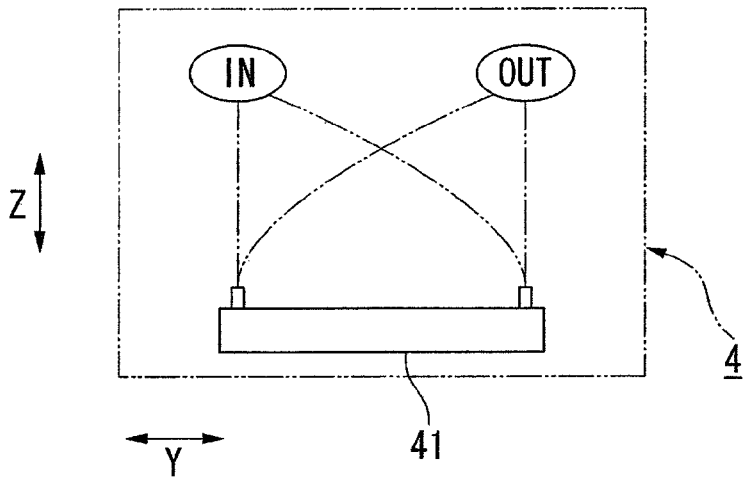
FIG. 12 is a schematic view of the liquid jet head.
Figure 13:
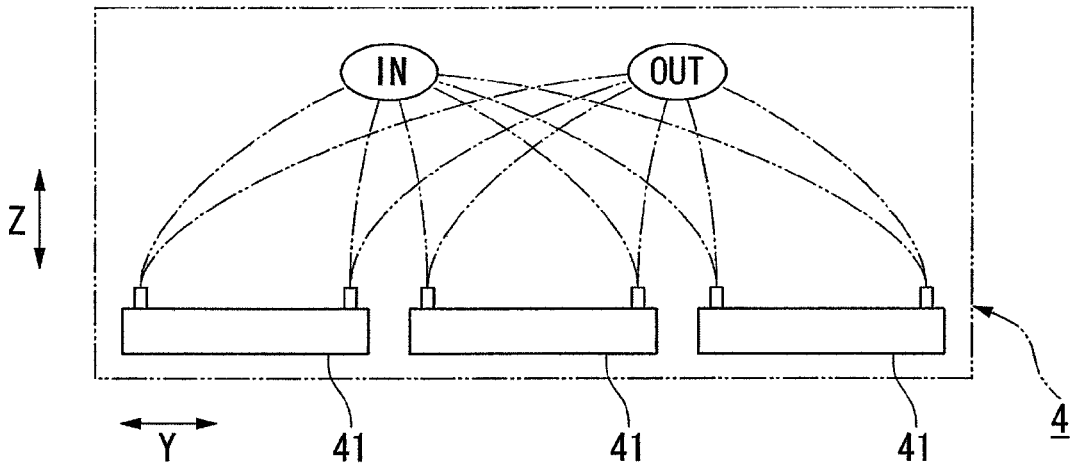
FIG. 13 is a schematic view illustrating a modified example of the liquid jet head.

Note that, the liquid jet head 4 in the above-mentioned embodiment may have a single head chip 41 provided as illustrated in FIG. 12, and, may have a plurality of head chips 41 arranged side by side in the direction of the nozzle array (Y direction) as illustrated in FIG. 13. In the latter case, while the number of the nozzles is large, difference in volume of ejected ink can be inhibited in the longitudinal direction of the head chip 41 (and the liquid jet head).

Further, the sum of pressures of ink supplied from the first and second circulation paths 21*a* and 21*b* to the liquid jet channels 12A can be set uniform in the longitudinal direction of the head chip 41 by, instead of providing the manifold blocks 39 at both the end portions of the head chip 41 in the longitudinal direction, providing the manifold blocks 39 in a middle portion in the longitudinal direction, providing three or more circulation paths in the flow path plate 16, or the like.

The structure described in the above-mentioned embodiment is only exemplary and various modifications are possible within the gist of the present invention.

What is claimed is:

1. A head chip for a liquid jet head of a liquid jet recording apparatus, the head chip comprising:

an actuator plate having, in one side surface thereof, a plurality of liquid jet channels arranged in a longitudinal direction of the head chip;

a flow path plate mounted to the one side surface of the actuator plate and covering the plurality of liquid jet channels; and a nozzle plate having a plurality of nozzle holes communicating with the plurality of liquid jet channels, wherein the flow path plate has a first circulation path and a second circulation path extending in the longitudinal direction of the head chip and communicating with each of the plurality of liquid jet channels, and wherein the first circulation path communicates with a first inflow port at one longitudinal end portion of the head chip for inflowing liquid into the first circulation path and the second circulation path communicates with a second inflow port at the other longitudinal end portion of the head chip for inflowing liquid into the second circulation path so that liquid flows through the first and the second circulation paths in opposite directions while being supplied to the plurality of liquid jet channels.

2. The head chip according to claim 1, further comprising:

a first manifold portion that includes the first inflow port for supplying liquid to the first circulation path and for discharging excess liquid which flows through the second circulation path; and a second manifold portion that includes the second inflow port for supplying liquid to the second circulation path and for discharging excess liquid which flows through the first circulation path.

3. The head chip according to claim 2, wherein the first manifold portion is provided at the one longitudinal end portion of the head chip and the second manifold portion is provided at the other longitudinal end portion of the head chip.

4. The head chip according to claim 1, wherein the head chip comprises a plurality of single head chips each comprising one actuator plate and one flow path plate.

5. The head chip according to claim 4, wherein the first circulation path and the second circulation path in the flow path plate comprise grooves which are open to a side opposite to the actuator plate, wherein the first circulation path and the second circulation path have, in bottom portions thereof, a plurality of first communicating openings and a plurality of second communicating openings, respectively, which reach the portions of the plurality of liquid jet channels in the actuator plate, and wherein the plurality of single head chips are coupled in pairs so that open portions of the first circulation paths and the second circulation paths in the flow path plates thereof are opposed to each other.

6. The head chip according to claim 4, wherein the plurality of nozzle holes and the plurality of liquid jet channels are arranged so that positions thereof are offset in the longitudinal direction in the head chip between adjacent single head chips.

7. A liquid jet head, comprising the head chip according to claim 1.

8. The liquid jet head according to claim 7, wherein the head chip comprises a plurality of head chips arranged side by side in a direction of a nozzle array.

9. A liquid jet recording apparatus, comprising:

the liquid jet head according to claim 7 or 8;

a liquid supplying portion for supplying liquid to the liquid jet head; and a recording medium conveying portion for conveying a recording medium so as to pass a location opposed to the liquid jet head.

* * * * *